US007044292B2

(12) United States Patent
Nall

(10) Patent No.: US 7,044,292 B2
(45) Date of Patent: May 16, 2006

(54) CLEANING DEVICE FOR UTENSILS DURING CAMPING ACTIVITIES

(76) Inventor: Robert Nall, 2100 Grandview Ave., Manhattan Beach, CA (US) 90266

( * ) Notice: Subject to any disclaimer, the term of this patent is extended or adjusted under 35 U.S.C. 154(b) by 0 days.

(21) Appl. No.: 10/682,468

(22) Filed: Oct. 9, 2003

(65) Prior Publication Data

US 2005/0077195 A1 Apr. 14, 2005

(51) Int. Cl.
*B65D 77/00* (2006.01)

(52) U.S. Cl. ..... 206/216; 220/769

(58) Field of Classification Search ..... 206/216, 206/232, 249, 361, 362, 362.3, 15.2, 15.3, 206/372, 373; 220/4.01, 4.04, 760, 765, 220/769, 770, 771, 772, 774, 528, 23.53, 220/23.87, 740; 99/410, 413, 422; 215/321
See application file for complete search history.

(56) References Cited

U.S. PATENT DOCUMENTS 4,106,486 A * 8/1978 Lee ..... 126/369
4,351,448 A * 9/1982 Ingersoll et al. ..... 220/318
4,941,401 A * 7/1990 Sarnoff et al. ..... 99/446
5,088,618 A * 2/1992 Colombo ..... 220/23.83
5,186,329 A * 2/1993 Fogelberg ..... 206/372
5,373,779 A * 12/1994 Grusin ..... 99/458
5,400,916 A * 3/1995 Weber ..... 220/495.02
RE35,933 E * 10/1998 Scholl ..... 220/695
6,405,638 B1 * 6/2002 Chen ..... 99/318
6,705,210 B1 * 3/2004 Leonard ..... 99/413
2003/0197014 A1 * 10/2003 Muchin et al. ..... 220/318

* cited by examiner

*Primary Examiner*—Shian T. Luong
(74) *Attorney, Agent, or Firm*—Roy A. Ekstrand

(57) ABSTRACT

A cleaning device includes an outer container having an open upper edge and a closed bottom and side wall together with a nesting strainer shaped and sized to be received within the outer container. A plurality of apertures are formed in the lower portion of the side wall and bottom surface of the strainer to drain liquids therefrom. A lid shaped and configured to be received upon the upper edge of the container and strainer provides closure of the cleaning device. A pair of handles are independently secured to the strainer and outer container for convenient carrying.

5 Claims, 3 Drawing Sheets

CLEANING DEVICE FOR UTENSILS DURING CAMPING ACTIVITIES

FIELD OF THE INVENTION

This invention relates generally to utensil cleaning apparatus and particularly for cleaning apparatus which may readily be used in outdoor activities such as camping or the like.

BACKGROUND OF THE INVENTION

A variety of outdoor recreational activities such as camping or the like have grown in popularity through the years as more and more persons living urban existences have gravitated toward outdoor types of recreation. In related commercial and industrial circumstances, similar needs to live outdoors in relatively sparse circumstances arises. In some instances, campers or outdoor workers utilize elaborate equipment such as campers, trailers or temporary structures to assist in living outdoors. Such equipment provides convenience and to some extent comfort in outdoor living activities. Despite great advances in such equipment varying from elaborate expensive mobile homes and trailers to smaller facilities carried by pickup trucks or the like, a great number of people are required or, some instance, prefer to utilize relatively little in the way of outdoor conveniences during camping and other activities.

As a result, many campers and other persons living outdoors find themselves living in relatively sparse circumstances with little in the way of modern conveniences. While this greatly adds to the charm and economy of the camping or other living activities, life in such limited circumstances often renders relatively simple tasks such as sleeping, eating and recreating rather difficult. One task which is time consuming in circumstances related to camping and other outdoor activities is found in the mundane activities relating to the utensils employed in food preparation, cooking and eating.

In the absence of modern conveniences, cleaning, drying and storing such utensils in the great outdoors is a difficult and time consuming as well as laborious activity. Thus, there arises a continuing and unfulfilled need in art for a convenient, lightweight and easy to utilize apparatus for cleaning utensils during camping or other outdoor activities.

SUMMARY OF THE INVENTION

It is a general object of the present invention to provide an improved apparatus for cleaning utensils during camping and other outdoor activities. It is a more particular object of the present invention to provide an improved cleaning device for utensils used during camping activities which is light weight, easy to utilize and which requires simple hand manipulation. It is a still more particular object of the present invention to provide a cleaning device for utensils used during camping and other outdoor activities which further provides convenient storage and transport of utensils such as cooking and food preparation apparatus in connection with camping and other outdoor activities.

In accordance with the present invention there is provided a cleaning device for use in camping or other outdoor environments, the cleaning device comprising: an outer container having a first sidewall, a first closed bottom end and a first upper open edge and defining a first interior cavity; a strainer having a second sidewall, a second closed bottom end and a second upper open edge and defining a second interior cavity, the second sidewall and the second closed bottom defining a plurality of apertures; and a lid received upon the second upper edge, the strainer being sized and shaped to rest within the outer container.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, in the several figures of which like reference numerals identify like elements and in which:

DESCRIPTION OF THE PREFERRED EMBODIMENTS OF THE INVENTION

Figure 1:
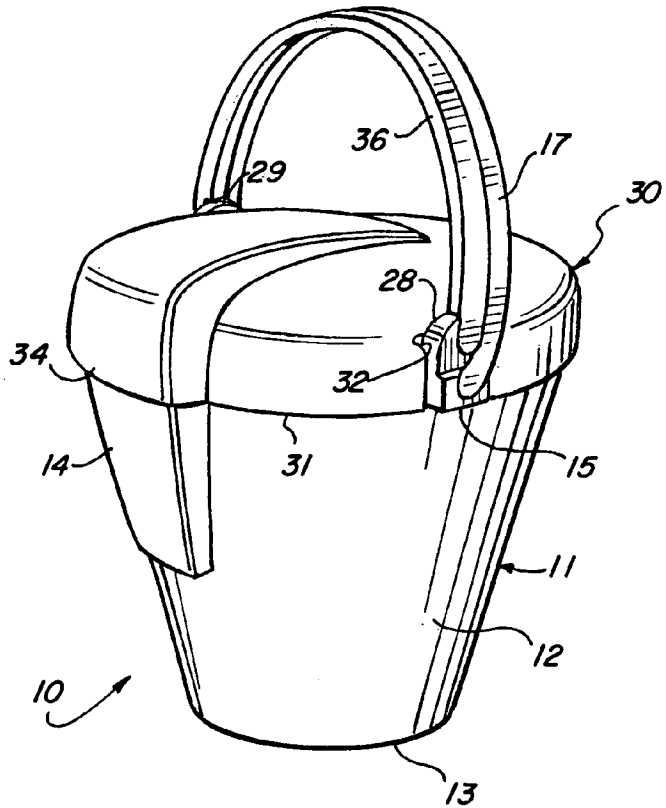
FIG. 1 sets forth a perspective view of a cleaning device constructed in accordance with the present invention in its closed or storage configuration.

FIG. 1 sets forth a perspective view of a cleaning device constructed in accordance with the present invention and generally referenced by numeral 10. Cleaning device 10 is shown in FIG. 1 in its closed or storage configuration in which all components are enclosed within the interior of device 10. In this closed configuration, device 10 shows an outer container 11 having a generally tapered side wall 12 and a closed bottom 13. Side wall 12 further forms a pouring spout 14. Cleaning device 10 further includes a conforming lid 30 received upon outer container 11 and providing closure thereof. Lid 30 generally conforms to the upper portion of outer container 11 and thus defines a spout cover 34 configured to generally enclose the upper portion of pouring spout 14.

To provide convenient carrying of cleaning device 10, a pair of handle supports 15 and 16 (handle support 16 seen in FIG. 2) on opposed sides of side wall 12 receive the end portions of a generally U-Shaped pivotally supported handle 17. Handle 17 is secured within handle supports 15 and 16 using conventional fabrication (not shown). The essential element of securing handle 17 within handle supports 15 and 16 is the provision of secure attachment while facilitating pivotal movement of handle 17 between the raised position shown in FIG. 1 and the relaxed position shown in FIG. 2. As is better set forth below in FIG. 2, cleaning device 10 further includes a strainer 20 which is received within outer container 11 when cleaning device 10 is configured in the closed or storage configuration shown in FIG. 1. Suffice it to note here that strainer 20 is received within and enclosed within side wall 12 of outer container 11. Further, as is also shown below in FIG. 2 in greater detail, strainer 20 includes a pair of handle supports 28 and 29 which are received upon the upper portions of handle supports 15 and 16. Handle supports 28 and 29 further support a pivotable U-Shaped handle 36. As with handle 17, handle 36 is secured to supports 28 and 29 in a pivotal attachment such that handle 36 may be raised to the position shown in FIG. 1 or pivoted downwardly to the relaxed or open position shown in FIG. 2.

Figure 2:
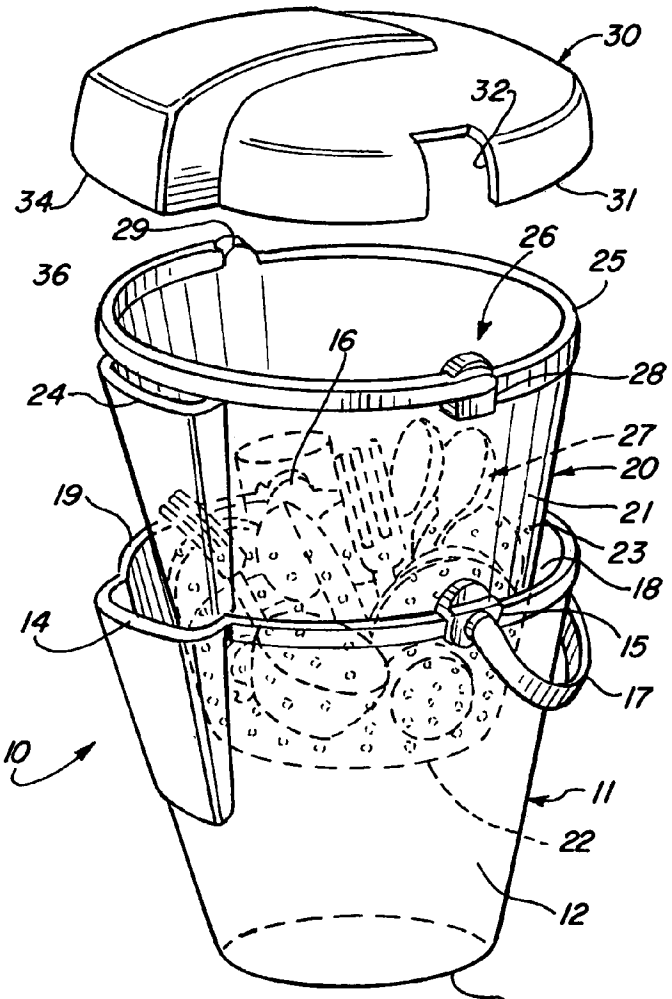
FIG. 2 sets forth a perspective assembly view of the components of the present invention cleaning device shown in FIG. 1.
Figure 3:
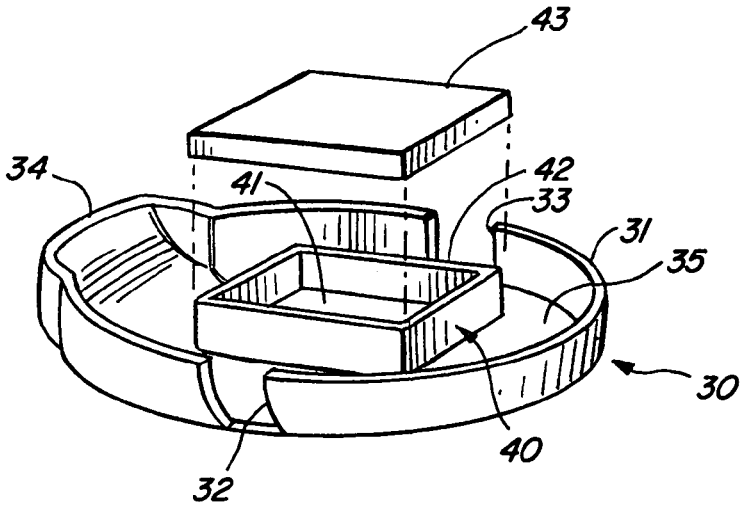
FIG. 3 sets forth a perspective of an alternate embodiment of the present invention showing a storage compartment beneath the device lid.

To accommodate the closure of cleaning device 10 by lid 30 in the configuration shown in FIG. 1, lid 30 defines a pair of notches 32 and 33 (notch 33 better seen in FIG. 3). The function of notches 32 and 33 is the provision of clearance between lid 30 and handle supports 15 and 16 of outer container 11 and handle supports 28 and 29 of strainer 20 (seen in FIG. 2).

Thus, in the closed or storage configuration shown in FIG. 1, the entire compliment of components of cleaning device 10 are conveniently stored within the device and are conveniently carried by handle 17 and 36. It will be noted by reference to FIG. 2 that the interior space within cleaning device 10 is available for storage space of utensils such as utensils 27 generally shown in FIG. 2. Thus, once the various utensils utilized in food preparation, cooking and eating in a camping or outdoor environment have been cleaned in the manner below, the cleaned utensils are conveniently stored and transported within the interior of cleaning device 10. This further adds to the utility and efficiency of the present invention cleaning device.

FIG. 2 sets forth an exploded view of cleaning device 10. As described above, cleaning device 10 is formed of three basic elements which comprise an outer container 11, a strainer 20 and a lid 30. More specifically, outer container 11 defines a generally tapered side wall 12 terminating in a closed bottom 13. Outer container 11 further includes an upper edge 19 having a pouring spout 14 formed therein. Outer container 11 thus defines a closed interior cavity 18 open along upper edge 19. A pair of handle supports 15 and 16 are formed in upper edge 19 and receive the end portions of a generally U-Shaped handle 17 in a conventional pivotal attachment. It will be noted with temporary return to FIG. 1, that handle 17 is angled outwardly at its attachment to handle supports 15 and 16 and thereafter defines a generally arcuate U-Shaped portion therebetween. The purpose of the angled portions formed in handle 17 is better seen in FIG. 1 as handle 17 is able to clear handle 36 of strainer 20 and thereby provide combined parallel, easy to carry handles 17 and 36.

Strainer 20 is shaped in general correspondence to the shape of outer container 11 and thus defines a side wall 21 and a pouring spout 24. In further accordance, strainer 20 defines an upper edge 25 and an interior cavity 26. A pair of handle supports 28 and 29 pivotally secure handle 36 to upper edge 25. In the preferred fabrication of the present invention, strainer 20 is shaped and sized to fit or nest within outer container 11 such that handle supports 28 and 29 partially overly and interlock with handle supports 15 and 16 of outer container 11. In addition, pouring spout 24 of strainer 20 is shaped and sized to nest within pouring spout 14. Upper edge 25 is thus able to rest upon upper edge 19 of outer container 11 to complete the component nesting thereof.

In further accordance with an important aspect of the present invention, a substantial portion of side wall 21 and bottom 22 include a plurality of apertures 23 formed therein. Apertures 23 are distributed about the lower portion of side wall 21 and bottom 22 of strainer 20 to facilitate the rapid draining of water from interior cavity 26 of strainer 20.

A lid 30 includes a pouring spout cover 34 and a lower edge 31. Lid 30 further includes a pair of notches 32 and 33 (notch 33 seen in FIG. 3) on opposed sides thereof. Lid 30 is sized and shaped to be received upon strainer 20 and outer container 11 in the storage configuration shown in FIG. 1. In this manner, lid 30 provides closure of interior cavity 26 of strainer 20 as well as interior cavity 18 of outer container 11.

In operation, a plurality of utensils generally referenced by numeral 27 and shown in dashed line representation in FIG. 2 are received within interior cavity 26 of strainer 20. Initially, during transport and storage, utensils 27 are cleaned and dried and thus are simply stored and carried within interior cavity 26 with cleaning device 10 in the closed configuration shown in FIG. 1. However, in accordance with the intended use of cleaning device 10, the user initiates the cleaning process by placing a quantity of soapy water within interior cavity 18 of outer container 18. Thereafter, interior cavity 26 of strainer 20 is filled with a quantity of utensils 27 to initiate the cleaning process. Thereafter, the user simply immerses strainer 20 supporting utensils 27 into outer container 11. The plurality of apertures 23 formed in side wall 21 and bottom 22 allow the flow of soapy water into interior cavity 26 as strainer 20 is placed within interior cavity 18.

At this point, utensils 27 are subjected to soapy water for cleaning purposes and may be variously agitated or manipulated either using hand cleaning tools such as sponges or the like or simply agitated within outer container 11 and strainer 20. Once the cleaning step has been completed, the user simply raises strainer 20 from outer container 11 carrying utensils 27 therewith. Apertures 23 of strainer 20 allow the soapy water to then drain into interior cavity 18 of outer container 11. Outer container 11 is then conveniently emptied and rinsed. Concurrently, strainer 20 carrying utensils 27 is rinsed in accordance with the available facilities within the camping area such as a source of running water. Alternatively, outer container 11 may be filled from a convenient water source and thereafter utilized to pour rinsing water into interior cavity 26 producing a rinsing action for utensils 27. The rinse water of course travels outwardly through apertures 23 in side wall 21 and bottom 22. Several rinse cycles may be repeated to ensure that utensils 27 are properly rinsed. Thereafter, utensils 27 may remain within interior cavity 26 of strainer 20 and allowed to dry. Finally, after sufficient drying has taken place, strainer 20 bearing utensils 27 may be stored within outer container 11 and lid 30 replaced to provide closure in the manner shown in FIG. 1. With cleaning device 10 returned to the closed configuration of FIG. 1, handles 17 and 36 may be raised and the entire device supporting and storing utensils 27 may now be conveniently transported and carried.

FIG. 3 sets forth a perspective assembly view of an alternative embodiment of cleaning device 10 which enhances the utility of lid 30. By way of overview, the alternate embodiment of lid 30 shown in FIG. 3 is substantially identical to the embodiment of lid 30 shown in FIG. 2 with the addition of a convenient storage compartment generally referenced by numeral 40 on the underside thereof.

More specifically, as described above, conforms generally to the shape of strainer 20 and outer container 11 (seen in FIG. 2) and thus defines a spout cover 34, a lower edge 31 and a pair of notches 32 and 33. Lid 30 further defines an interior cavity 35. The space within an interior cavity 35 is utilized in the alternate embodiment of FIG. 3 to support a convenient storage compartment 40 having an interior cavity 41 formed therein. Storage compartment 40 further includes a cover 43 which is snap-fitted upon edge 42 of storage compartment 40 to provide secure closure thereof. In the anticipated use of storage compartment 40 within lid 30, the user is able to conveniently store and maintain related apparatus such as soap, soap containers, sponges or other cleaning apparatus.

It will be apparent to those skilled in the art that the generally tapered cylindrical shape set forth for outer container 11 and strainer 20 of cleaning device 10 is merely an example of a selected shape for the present invention cleaning device. Accordingly, it will be equally apparent to those skilled in the art that a variety of differently shaped devices operating in the manner described above in FIGS. 1 and 2 may readily be envisioned without departing from the spirit and scope of the present invention. While a substantial number of differently shaped cleaning devices may be constructed within the spirit and scope of the present invention, FIGS. 4 and 5 set forth an illustrative example of a differently shaped cleaning device which operates within the spirit and scope of the present invention. Thus, FIGS. 4 and 5 set forth an alternate embodiment of the present invention cleaning device which operates in the same manner as the above described embodiment set forth as cleaning device 10 while being fabricated in a different shape. In the illustration shown in FIGS. 4 and 5, a generally rectangular shape has been selected for an alternative embodiment of the present invention. Once again, it must be emphasized however that neither the generally cylindrical embodiment shown in FIGS. 1 and 2 nor the generally rectangular embodiment shown in FIGS. 4 and 5 provide any limitation of the present invention device as to its shape.

Figure 4:
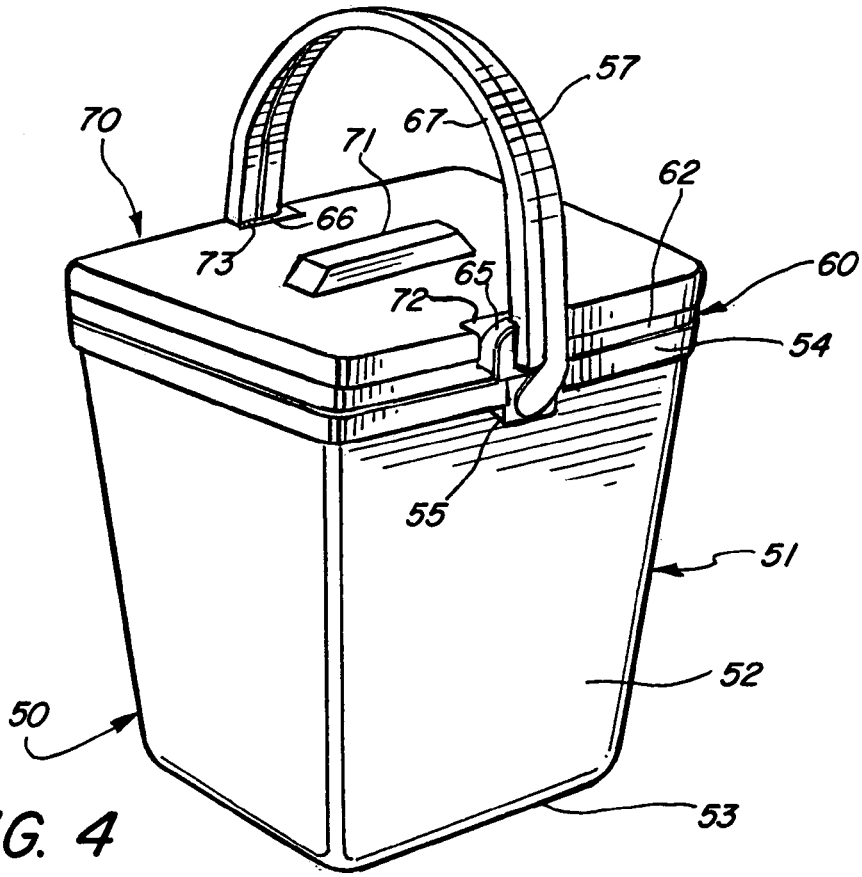
FIG. 4 sets forth a perspective view of an alternate embodiment of the present invention cleaning device in its closed or storage configuration.
Figure 5:
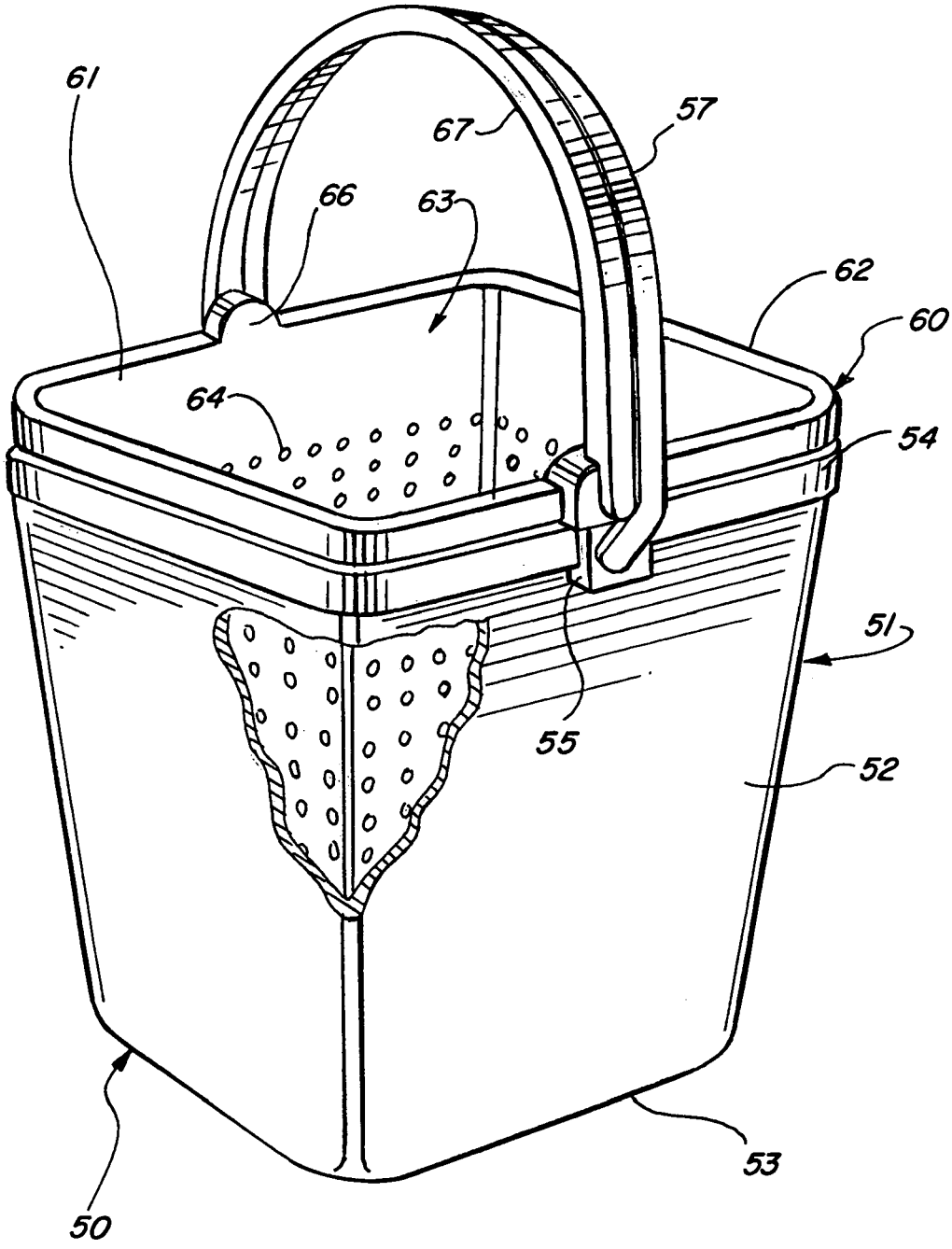
FIG. 5 sets forth a partially sectioned perspective view of the alternate embodiment of the present invention set forth in FIG. 4.

More specifically, FIG. 4 sets forth a perspective view of an alternate embodiment of the present invention cleaning device generally referenced by numeral 50. Device 50 includes an outer container 51 having a side wall 52 and a closed bottom 53. Outer container 51 further includes an upper edge 54 and a pair of handle supports 55 and 56. Cleaning device 50 further includes a strainer 60 (better seen in FIG. 5) having an upper edge 62 and a pair of handle supports 65 and 66. Outer container 51 further includes a handle 57 pivotally secured to handle supports 55 and 56 while strainer 60 includes a handle 67 pivotally secured to handle supports 65 and 66.

Cleaning device 50 further includes a generally planar lid 70 having a handle 71 formed on the upper surface thereof. Lid 70 further defines a pair of notches 72 and 73 which provide clearance for handle supports 65 and 66 of strainer 60.

In the configuration shown in FIG. 4, cleaning device 10 is in its closed or storage configuration in which strainer 60 is received within outer container 51 and in which lid 70 is received upon strainer 60 to provide closure of the combined structure of cleaning device 50. In accordance with the above described embodiment of cleaning device 10, cleaning device 50 utilizes handles 57 and 67 in a raised generally parallel configuration to provide convenient carrying of cleaning device 50. It will be noted that handle 57 includes angled portions which provide clearance of handle 67 in the manner described above for cleaning device 10 thereby facilitating easy carrying of cleaning device 50 by both handles 57 and 67.

FIG. 5 sets forth a perspective partially sectioned view of cleaning device 10 having lid 70 removed therefrom. As described above, cleaning device 50 includes an outer container 51 having a side wall 52 and a closed bottom 53. Outer container 51 further supports a pair of handle supports 55 and 56 and an upper edge 54. A handle 57 is pivotally secured to supports 55 and 56. A strainer 60 sized and shaped to generally conform to and nest within outer container 51 includes a side wall 61 defining a plurality of apertures 64. Strainer 60 further defines an interior cavity 63 and a pair of handle supports 65 and 66 supported on opposed sides of upper edge 62. A handle 67 is pivotally secured to supports 65 and 66.

In operation, cleaning device 50 functions in the identical manner to cleaning device 10 described above in which a quantity of utensils may be stored within interior cavity 63. In further correspondence to cleaning device 10, a quantity of soapy water may be placed within outer container 51 and a quantity of to-be-cleaned utensils may be deposited within interior cavity 63 of strainer 60. Thereafter, the above-described cleaning practices are carried forward and utensils once cleaned and dried may be conveniently stored and transported within interior cavity 63 of strainer 60.

While a variety of materials may be utilized in fabricating the above-described inventive cleaning devices, it has been found economically advantageous and effective to fabricate the components of the present invention cleaning device using molded plastic materials or the like. Such materials are somewhat flexible and resilient providing substantial protection for the interior contents such as utensils of the like. Concurrently, molded plastic components are economical and low-cost to fabricate and are typically available in a variety of pleasing and appropriate colors. In addition, molded plastic materials avoid problems of rust and corrosion otherwise possible in metal fabrications. However, it will be recognized that the present invention cleaning device may, in certain environments, be preferably fabricated of metal material or other materials as desired without departing from the spirit and scope of the present invention.

What has been shown is a cleaning device which is particularly fabricated and designed to provide convenient efficient and low-cost cleaning of food preparation and eating utensils in a camping environment or other outdoor environment. The device provided utilized a pair of nesting containers and cooperating lid to provide secure coverage and closure for utensils during transport and storage.

While particular embodiments of the invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention.

I claim:

1. A cleaning device for use in camping or other outdoor environments, said cleaning device comprising:

an outer container having a first sidewall, a first closed bottom end, a first upper open edge, a first handle pivotally coupled to said first upper edge and defining a first interior cavity;

a strainer having a second sidewall, a second bottom end, a second upper open edge a second handle pivotally coupled to said second upper edge and defining a second interior cavity, said second sidewall and said second bottom defining a plurality of apertures; and a lid received upon said first upper edge, said first and second upper open edges defining respective first and second pairs of handle supports for pivotally supporting said first and second handles respectfully, each of said first and second handle supports constructed to nest with each other to position said second handle alongside said first handle when raised, said strainer being sized and shaped to rest within said outer container.

2. The cleaning device set forth in claim 1 wherein said lid defines a pair of opposed notches constructed to receive said first and second handle supports when nested which allows said first and second handles to be raised and lowered with said lid in place, said first and second pairs of handle supports being aligned when nested to be receivable into said notches.

3. The cleaning device set forth in claim 2 wherein said outer container defines a first pouring spout and wherein said strainer forms a rigid body retaining its shape when lifted by said second handle and having a quantity of articles within said second interior cavity and defines a second pouring spout.

4. The cleaning device set forth in claim 3 wherein said lid defines an undersurface having a storage compartment formed therein.

5. The cleaning device set forth in claim 1 wherein said first and second handle supports when nested each support said first and second respective handles at pivotal attachments which are vertically in-line and wherein said first handle defines a pair of angled portions at said first handle supports to align the remainder of said first handle alongside said second handle when both handles are raised.

* * * * *